United States Patent [19]

Valentine

[11] 4,281,417

[45] Aug. 4, 1981

[54] INFLATABLE WATERPROOF BATHING CAP

[76] Inventor: Michael Valentine, 78 Tower Rd., Pine Lakes, Wayne, N.J. 07470

[21] Appl. No.: 150,307

[22] Filed: May 16, 1980

[51] Int. Cl.[3] ..... A42B 1/12

[52] U.S. Cl. ..... 2/68

[58] Field of Search ..... 2/68, DIG. 10, DIG. 3, 2/421, 90 C, 107, 108, 213, 216; 128/140

[56] References Cited

U.S. PATENT DOCUMENTS 3,026,526 3/1962 Montrose ..... 2/68

FOREIGN PATENT DOCUMENTS 493162 10/1938 United Kingdom ..... 2/68

668751 3/1952 United Kingdom ..... 2/68

*Primary Examiner*—Doris L. Troutman

*Attorney, Agent, or Firm*—Orville N. Greene

[57] ABSTRACT

A bathing cap of the type having an inflatable edge portion so that the edges may be more closely sealed to the head of the wearer when the edge portion is inflated and a tubular chin strap through which the edge portion can be inflated by blowing through the tube, is provided with an improved fastening means which is flexible, non-metallic, does not interfere with the inflating process, and comprises a first part in the form of a projection with a neck and a bulbous head attached to the bathing cap and a second part in the form of a sleeve slidable on the tubular chin strap but containing a pair of openings through which the first part can be forced.

1 Claim, 4 Drawing Figures

FIG. 1
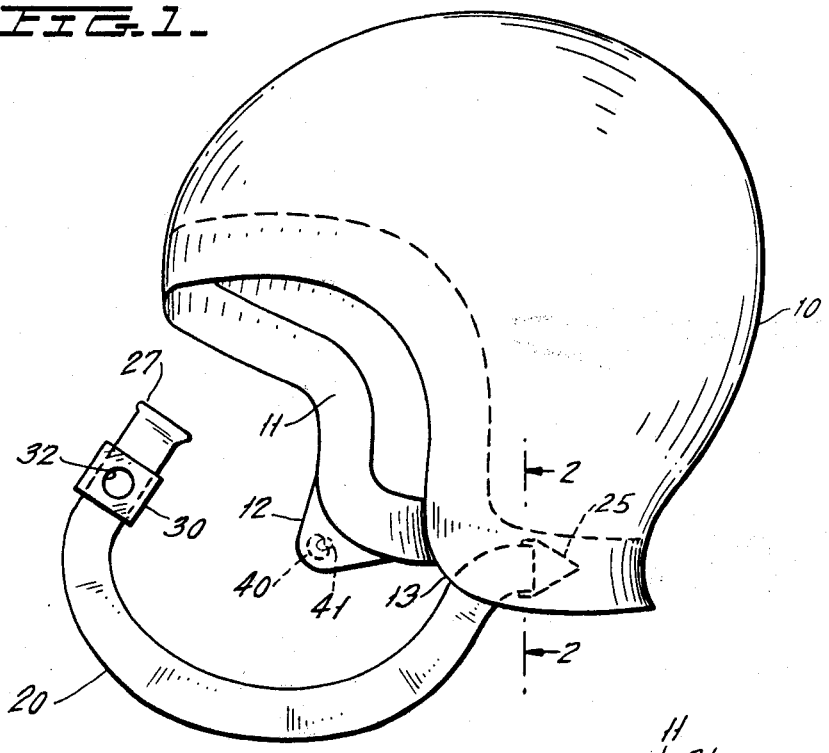
FIG. 3
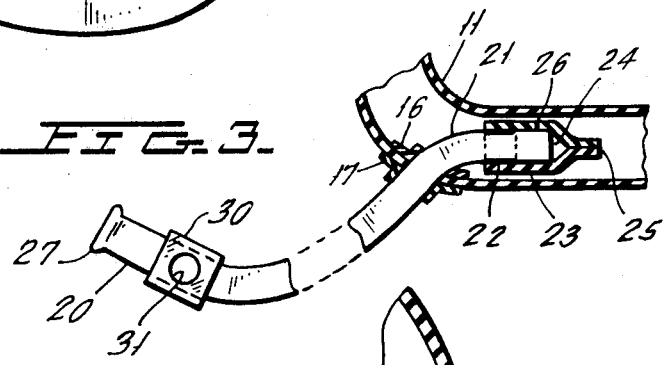
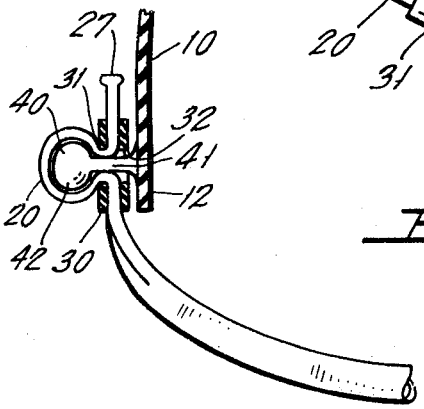
FIG. 4
FIG. 2
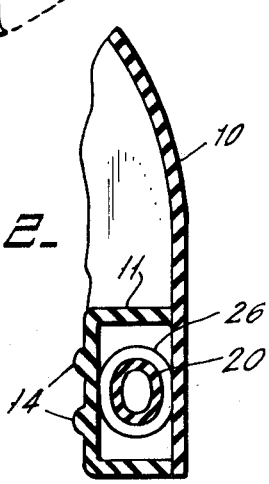

INFLATABLE WATERPROOF BATHING CAP

This invention relates to a bathing cap of the type having an internal inflatable chamber extending around the edges of the cap to provide an improved seal against leakage of water into the cap when the chamber is inflated.

Caps of this type are disclosed in several prior patents such as Montrose U.S. Pat. No. 3,026,526, Gasaway U.S. Pat. No. 3,108,283, Vail U.S. Pat. No. 3,113,319, Weissberg U.S. Pat. No. 3,403,406. Montrose also discloses a tube for inflating the internal chamber which tube also serves as a chin strap, but the attaching means for the chin strap comprises a male-female snap, the male part of the snap fastener being part of a flat metal member which slides on and flattens the tubular strap making it difficult to inflate the cap chamber. Gasaway also discloses a tubular inflating means with a mouthpiece which apparently can become the chin strap but no fastening means is disclosed for the tube.

Among the objects of the invention is to provide a bathing cap with an inflatable chamber which may be readily inflated through a tubular chin strap provided with a fastening means which does not interfere with the internal passage of the tube.

Among other objects of the invention is to provide a bathing cap with an inflatable chamber operative to seal the edges of the cap against water leakage which is simpler to manufacture.

These objects are accomplished by forming the cap with an internal chamber running around the edges thereof and with tubular means connecting with said chamber provided with a simplified valve at the end within the chamber and with a simple fastening means in the form of a short flexible sleeve surrounding the tube at the opposite end. The short flexible sleeve fits closely about the tube but is slidable thereon and is provided with two holes on opposite sides thereof adapted to admit a bulbous male fastening member formed on the bathing cap. To fasten the tube the bulbous member is forced through the two holes in the sleeve carrying the elastic tubular member with it partially by stretching and partially by sliding said tubular member.

Further objects and features of the invention will be apparent from the subjoined specifications and claims to form a consideration of the accompanying drawings showing an embodiment thereof.

In the drawings:

FIG. 1 is a view of a finished bathing cap made according to the invention.

FIG. 2 is an enlarged detail cross-sectional view taken on line 2—2 of FIG. 1.

FIG. 3 is a detail view partly in cross-section of the tube-chin strap of the invention.

FIG. 4 is a detail view of the fastening means of the invention in fastened position.

The cap 10 has a linear chamber 11 extending around the interior edge thereof. The chamber may follow the edge as illustrated or may be made to pass above the projecting portions 12 and 13 so as to be above the ears when the cap is worn. The chamber 11 may take any desired form, i.e., it may be square as shown, or oval or it may have one or more interior ridges 14 as shown in FIG. 2.

Adjacent the projecting portion 13, the tubular element 20 passes into the chamber 11 through orifice 13 and is securely fastened to the chamber as by elastic rubber washers 16 and 17.

The interior end 21 of tube 20 has a similar rubber tube 23 attached through a layer of cement to provide an air-tight seal in said area. Both tubes 20 and 23 extend beyond the cemented area 22, tube 20 ending at 24 and tube 23 ending in a pinched and sealed portion at 25. Intermediate the end 24 of tube 20 and the sealed area 22, a slit 26 is provided in tube 23 whereupon air forced into the end of tube 20 can pass through the end 24 and make a path for itself through slit 26 to the interior of chamber 11. The valve formed by tube 23 around tube 20 has no hard parts. Air can be released from the chamber 11 by pinching the chamber 11 from above, with a fingernail, for example, in the area of the slit 26.

The free end of tube 20 is provided with a beaded edge 27 to strengthen the edge making it easier to hold for blowing and to prevent the sleeve 30 from sliding off the end thereof. Sleeve 30 is made of flexible material such as rubber and may be somewhat thicker and/or less flexible than tube 20. The sleeve 30 fits closely about tube 20 but can slide thereon and it contains two circular openings 31, 32 on opposite sides thereof. The projecting portion 12 of said cap is provided on its outside with a projecting means 40 having a relatively long neck portion 41 and a bulbous end portion 42. The circular openings 31, 32 in said sleeve 30 are so coordinated with the size of the bulbous head 42 of projection 40 that the latter may be pushed through both orifices 31, 32 carrying a portion of the tube 20 with it so that the sleeve 30 and a portion of tube 20 is firmly held on the projection 40. As shown in FIG. 4. opening 31 may be somewhat larger than opening 32 since a portion of tube 20 must pass through opening 31. The projection 40 may be formed of the same material as the hard portion 10 of the bathing cap or it may be formed of somewhat harder material, i.e., rubber material which has been further vulcanized or cross-linked than the remainder of the cap. Thus, the entire cap, chin strap and fastening means can be made without any metallic parts.

I claim:

1. In a bathing cap of the type having an inflatable band portion and a tubular chin strap having a first end and a free end and the first end being connected to the inflatable band portion and through which the latter can be inflated, the improved means for attaching the free end of said chin strap to the cap comprising projecting means having a neck portion and a bulbous head portion attached to a region of the cap opposite the region where the first end of said tubular strap is attached, flexible sleeve means slidably mounted on said tubular chin strap, said flexible sleeve means having orifices on opposte sides thereof which are adapted to admit the bulbous head of the projecting portion whereby the free end of the strap may be attached to the projecting portion by forcing the head through said orifices.

* * * * *